United States Patent [19]

Price

[11] 4,059,275

[45] Nov. 22, 1977

[54] BOARD GAME

[76] Inventor: William Laurence Price, Harborough Road, Oadby, Leicester LE2 4LB, England

[21] Appl. No.: 650,301

[22] Filed: Jan. 19, 1976

[51] Int. Cl.[2] ..... A63F 3/00

[52] U.S. Cl. ..... 273/130 D; 273/136 C

[58] Field of Search ..... 273/130 R, 130 D, 130 E, 273/136 C, 137 AD

[56] References Cited

U.S. PATENT DOCUMENTS

| | | | |
|---|---|---|---|
| 1,932,524 | 10/1933 | Jackson, Jr. | 273/130 D |
| 1,988,301 | 1/1935 | Coffin | 273/130 D |
| 2,290,266 | 7/1942 | Bechtold | 273/130 D |
| 3,149,842 | 9/1964 | Cirrincione | 273/130 D |
| 3,179,414 | 4/1965 | Mertz et al. | 273/130 D |
| 3,191,937 | 6/1965 | Kropinski | 273/136 E |
| 3,514,110 | 5/1970 | Thomander | 273/130 D |

FOREIGN PATENT DOCUMENTS

| | | | |
|---|---|---|---|
| 582,709 | 9/1959 | Canada | 273/130 D |
| 1,235,515 | 5/1960 | France | 273/130 E |
| 310,848 | 9/1933 | Italy | 273/130 D |
| 237,642 | 8/1945 | Switzerland | 273/130 D |

*Primary Examiner*—Richard C. Pinkham
*Assistant Examiner*—Harry G. Strappello
*Attorney, Agent, or Firm*—Diller, Brown, Ramik & Wight

[57] ABSTRACT

The invention relates to a board game devised to exercise the powers of concentration and perceptive skill of two players. The board is provided with a grid pattern of apertures each having an identification such as B9, G7, H2, etc. The first player secretly draws two intersecting lines on a replica of the board and allocates one of four characteristics, for example, colors, to each of the four zones defined by the lines. The second player, by requesting to know the color zone allocated to chosen apertures, attempts to identify the point of intersection of the lines, using the identification of minimum possible number of apertures.

1 Claim, 5 Drawing Figures

BOARD GAME

Figure 1:
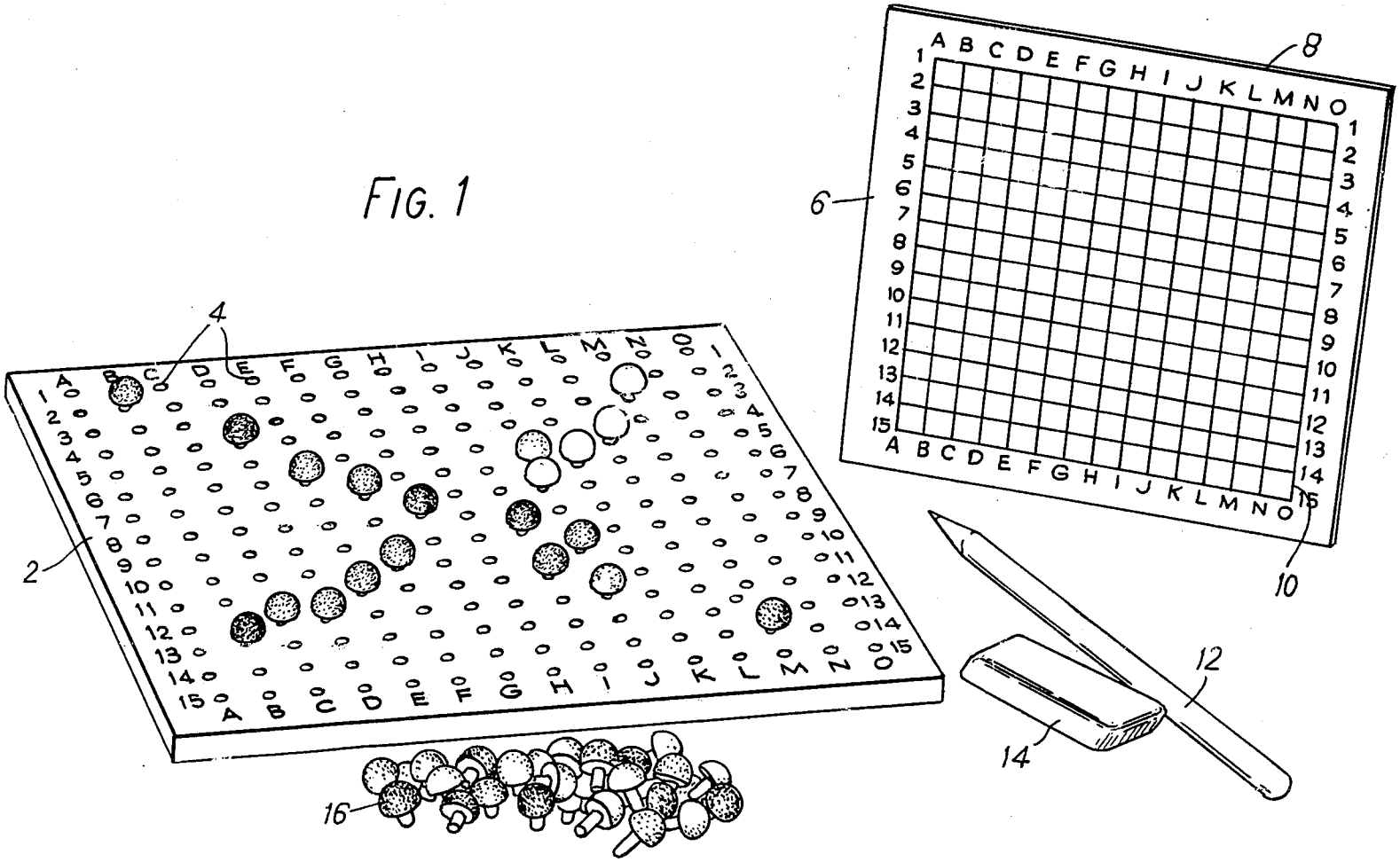

The invention relates to a board game intended for a player to exercise his powers of concentration and perceptive skill in the solution of a problem posed by his opponent. Points are awarded for the solution of each problem and the roles of the players are periodically exchanged so that the total number of points secured by each player over a number of games shall be compared and so provide the winner.

The invention provides a board game which comprises a board bearing identifiable grid positions, a plurality of test playing pieces each having a characteristic selected from a range of characteristics, and adapted to be mounted upon the board in selected ones of those positions in a test pattern, a plan marked out for use by a first player and corresponding to the grid positions on said board, on which plan two intersecting lines drawn by the first player are arranged to divide the plan into at least four regions each identifiable by one of the said range of characteristics, said regions converging on at least one target point.

Conveniently, the range of characteristics may be a plurality of different colours.

Preferably the plan is drawn on a surface which may readily be wiped clean, and a marker and eraser are provided with the game.

In playing the game, the first player selects a target point on the plan and draws two lines upon the plan which intersect at that point. He then designates the characteristics of the regions defined by the lines and the edges of the plan, for example, red, blue, green and yellow. The second player must identify the target point and calls out selected grid identifications, for example, combinations of a letter and a numeral to which the first player responds with the characteristic that he has allotted to that point on the grid. The second player then marks the board with a test playing piece having that characteristic. As the game progresses, so a picture builds up from which the second player can deduce the position of the target point.

The score is provided by the number of calls, i.e. test playing pieces used, which are necessary before a correct deduction is made, and this is awarded to the first player. The roles of the players are then reversed until an agreed number of games have been played. The player with the highest score wins.

A specific embodiment of the invention will now be described with reference to the accompanying drawings. It will be understood that the description is given by way of example only and not by way of limitation of the invention.

In the drawings:

FIG. 1 shows the board, a plan, a marker and an eraser, together with a plurality of test playing pieces of various colour characteristics; and FIGS. 2–5 show examples of various plan markings with target points.

FIG. 1 shows a board 2 having a plurality of regularly spaced apertures 4, arranged in a grid of fifteen rows with fifteen apertures in each. The individual apertures may be identified by means of letters A–O and numerals 1–15 marked on the margins of the board. Thus the central aperture may be identified as H8.

A plan 6 is provided on a support stand 8 so that it can readily be positioned out of the view of the second player. A grid 10 is marked out on the plan which corresponds to the grid formed by the apertures 4 on the board 2.

A marker pencil 12 and an eraser 14 are also provided, the surface of the plan being of plastics material which may be wiped clean after each use.

A plurality of test playing pieces are provided in the form of pegs, 16, twelve of which are red, twelve blue, twelve green, twelve yellow, twelve black, and two white.

The rules for the game can take the following forms.

Figure 2:
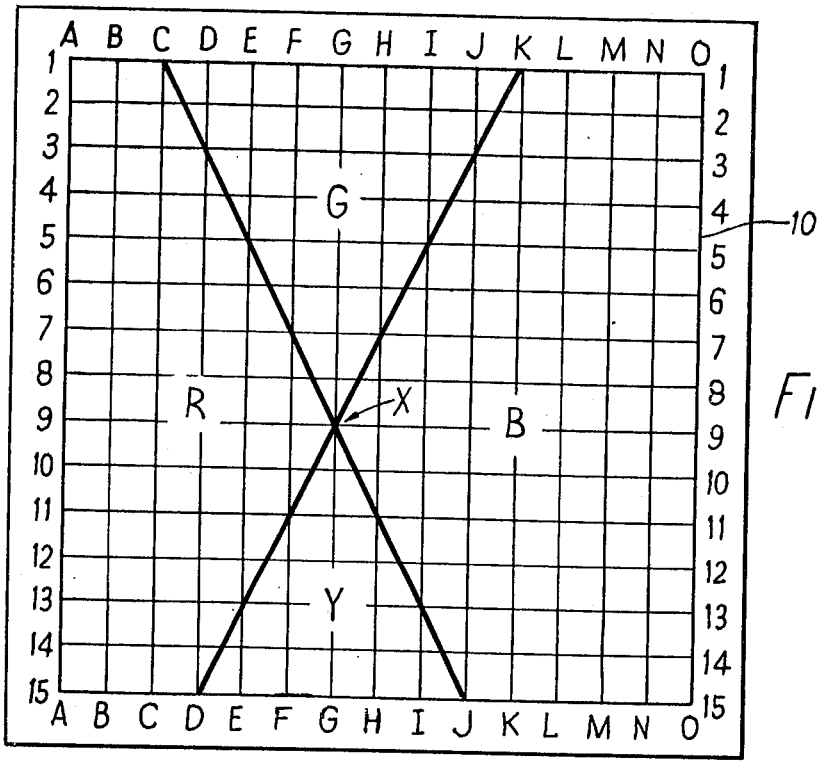
Figure 3:
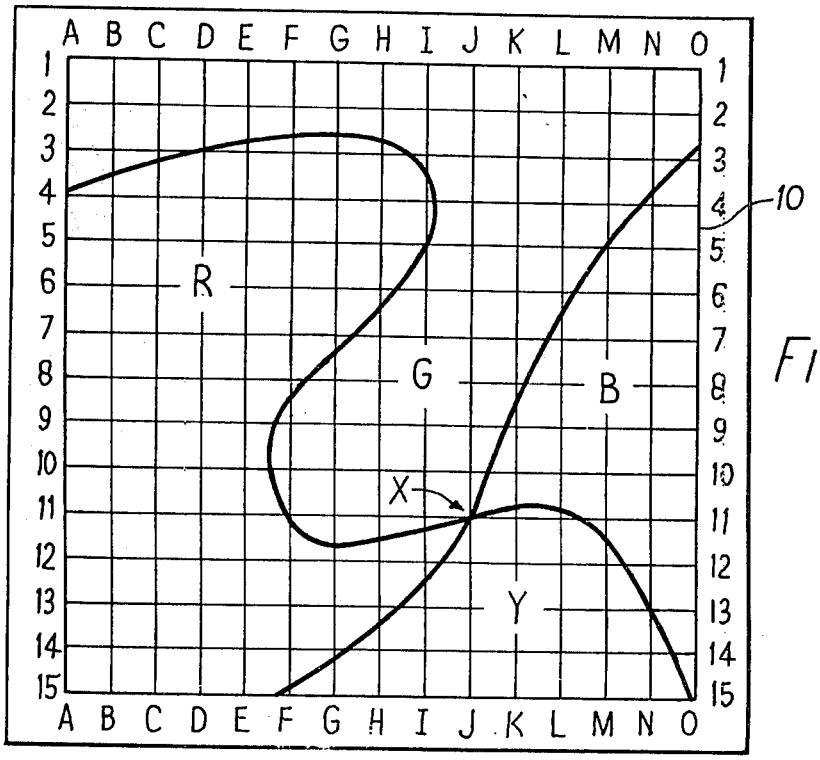

In its simplest form, as shown in FIG. 2, the game is commenced by the first player secretly drawing two straight lines A, B on the plan, intersecting at a target point X of his choice, in this case, aperture 9G. He then designates the four regions into which he has divided the plan by the four colours red, blue, green and yellow. The red region must always be opposed to the blue region.

The second player then commences to call out a series of aperture identification letter/number combinations. After each call, the first player states the colour characteristic of the region on his plan into which the called aperture falls; for example, aperture A2 is in the red region, and a red peg is inserted. When the second player calls an aperture which is on one of the lines, the first player replies that he must use a black peg. As the pattern developes on the board, the second player is able to deduce the possible position of the target point. When he does in fact call the aperture corresponding to the target point, the first player indicates that a white peg should be inserted in the board and the game is over.

The score is then assessed by counting the number of pegs inserted in the board, including the white peg. If the second player has used up all the pegs of any one colour, then an extra ten points are added to the first player's score. After a predetermined equal number of games, with the players' roles alternately reversed, the player with the highest score is the winner.

An alternative method of play uses the same rules and scoring procedure as above, but employs curved intersecting lines as shown in FIG. 2. It is to be observed that a greater number of pegs will usually be required to solve this alternative version of the game.

Figure 4:
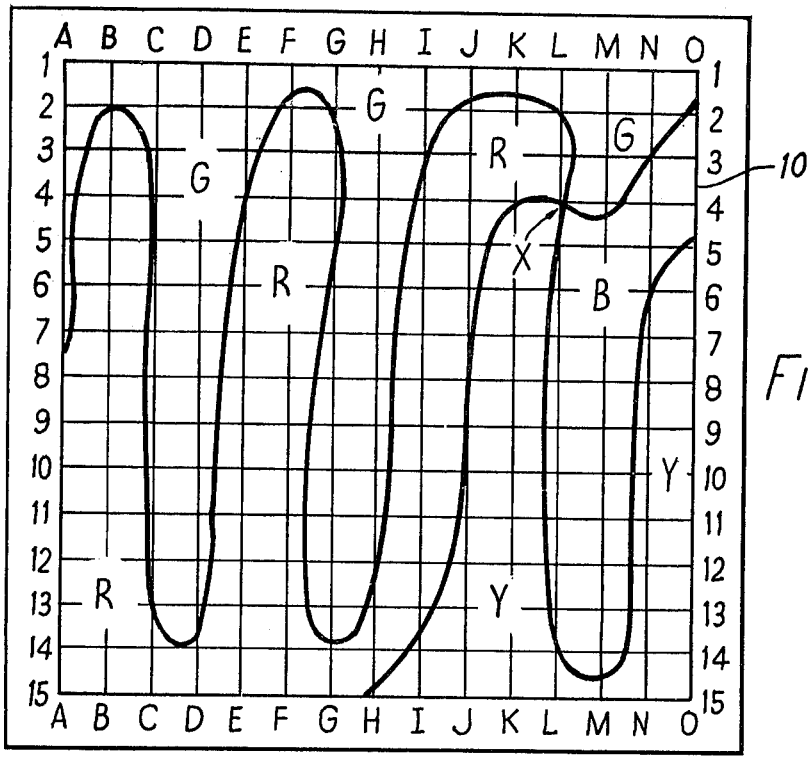
Figure 5:
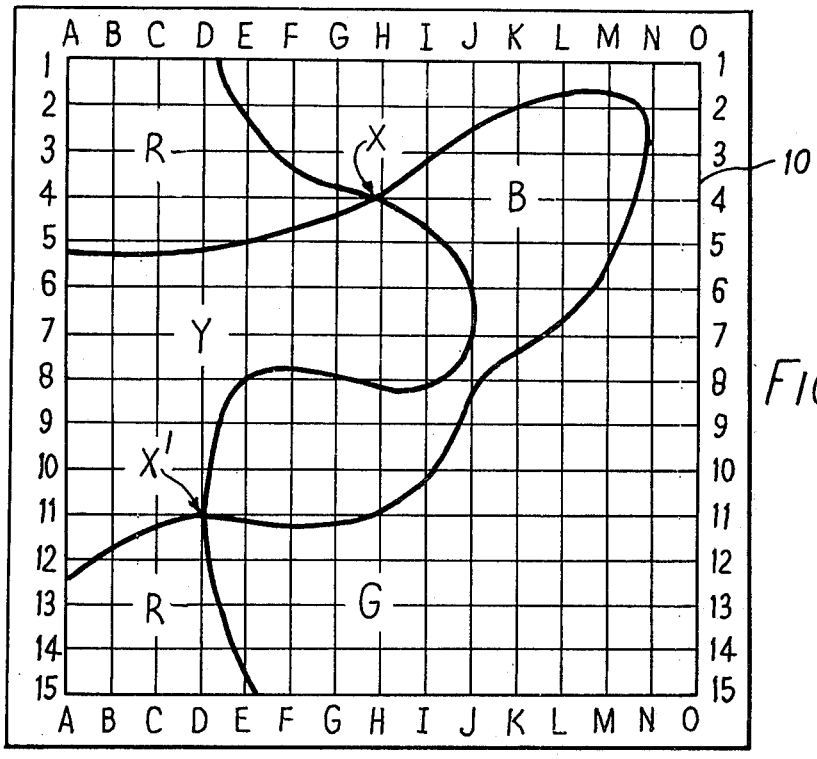

An exaggerated form of curved intersecting lines is shown in FIG. 4. However, the lines must not cross itself, that is, it must only intersect with the other line. Moreover each coloured region must be large enough in dimension to permit at least two pegs to be inserted in corresponding positions on the board.

No more than two lines may pass between two apertures on the board.

It is envisaged that the two lines drawn by the first player on the plan may intersect more than once if desired (see FIG. 5), but the discovery of any one of the target points so indicated concludes the game.

Various modifications may be made within the scope of the invention.

I claim:

1. A game set comprising a board having means thereon identifying grid positions, a plan having means thereon for identifying like grid positions, said plan having two lines dividing said plan into at least four identifiable regions with said lines intersecting in at least one target point and said four regions all converging on said target point, and test pieces for placement on said board for identifying on said board selected test positions among said grid positions, said test pieces including at least five identifiable groups of pieces, the pieces of four of said groups corresponding to said four regions and the pieces of a fifth of said group corresponding to said lines whereby a player using said test pieces and said board may determine said target point.

* * * * *